US006305626B1

(12) United States Patent
Korstvedt

(10) Patent No.: US 6,305,626 B1
(45) Date of Patent: Oct. 23, 2001

(54) COLLOID MILL

(75) Inventor: Harald O. Korstvedt, Harvard, MA (US)

(73) Assignee: APV North America, Inc., Wilmington, MA (US)

( * ) Notice: Subject to any disclaimer, the term of this patent is extended or adjusted under 35 U.S.C. 154(b) by 0 days.

(21) Appl. No.: 09/315,589

(22) Filed: May 20, 1999

(51) Int. Cl.[7] ..... B02C 13/20; B02C 7/00
(52) U.S. Cl. ..... 241/259.1; 241/261.1
(58) Field of Search ..... 241/259.1, 261.1

(56) References Cited

U.S. PATENT DOCUMENTS

| | | | | |
|---|---|---|---|---|
| 2,891,733 | | 6/1959 | Asplund | 241/256 |
| 3,224,689 | | 12/1965 | Behrens et al. | 241/256 |
| 3,788,565 | * | 1/1974 | Adama | 241/46.11 |
| 4,109,873 | | 8/1978 | Lichfield | 241/56 |
| 4,113,189 | * | 9/1978 | Sullivan | 241/43 |
| 4,994,212 | * | 2/1991 | Vos et al. | 264/3.3 |
| 4,999,033 | * | 3/1991 | Vos et al. | 149/109.6 |
| 5,605,290 | * | 2/1997 | Brenholdt | 241/21 |
| 5,795,583 | * | 8/1998 | Grune et al. | 424/400 |

FOREIGN PATENT DOCUMENTS

| | | |
|---|---|---|
| 1 607 493 | 9/1969 | (DE) . |
| 26 55 266 | 7/1978 | (DE) . |
| 32 21 476 | 12/1983 | (DE) . |
| 792227 | 3/1958 | (GB) . |
| 96526 | 12/1960 | (NL) . |

OTHER PUBLICATIONS

"Kolloidmühlen und Prozeβanlagen", *Chemie–Technik*, 14 Jahrgang, Nr. 11, pp. 110–114 (1985).

"Premier Colloid Mills, The Ultimate in Dispersing and Emulsifying", *Brochure for Premier Mill*, One Birchmont Drive, Reading, PA 19606–3298.

"Gifford–Wood Mixers, by Greerco", *Brochure for Chemineer, Inc.*, A Unit of Robbins & Meyers, Inc., 125 Flagship Drive, North Andover, MA 10845.

"Engineered Process Systems for High Technology Industries", *Brochure for Collaborative Process Systems, Inc.*, 25 East Loop Road, Stony Brook, NY 11790–3350.

"Wet Mixing Equipment", *Brochure for Bematek Systems, Incorporated*, 117 Elliott St., P.O. Box 264, Beverly, MA 01915.

(List continued on next page.)

*Primary Examiner*—Allen Ostrager
*Assistant Examiner*—William Hong
(74) *Attorney, Agent, or Firm*—Hamilton, Brook, Smith & Reynolds, P.C.

(57) ABSTRACT

A colloid mill utilizes a motor-driven shaft configuration that connects to the rotor of the colloid mill to the electric motor rotor. In this way, the mill rotor shaft is directly driven. Complex gear or belt drive arrangements between a separate electric motor and the fluid processing components of the colloid mill are thus avoided. Moreover, the gap between the mill rotor and mill stator can be adjusted simply by axially translating the motor-driven shaft. Such translation is provided by a timing belt-based arrangement to limit backlash. As a result, a simple hand-operated knob or stepper motor arrangement can be used to control the gap. Specifically, a thrust bearing is supported in a threaded sleeve that mates with the colloidal mill body. The timing belt engages the sleeve to rotate it relative to the body, thus adjusting the thrust bearings axially along the motor driven shaft and thereby controlling the gap between the mill stator and mill rotor. Also addressed are problems associated with scaling colloid mills and novel rotor configurations using regions of enlarged gap to facilitate the formation of cavitation fields. Precise measurement of the gap between the mill rotor and the mill stator is made possible by incorporating an analogous surface at the same angle as the mill rotor surface, against which a distance indicator can bear.

10 Claims, 7 Drawing Sheets

OTHER PUBLICATIONS

"Toothed Colloid Mill", *Brochure for Fryma–Maschinen AG*, CH–4310 Rheinfelden, Switzerland.
"Tri–Homo Colloid Mills", *Catalog TH980, Brochure for Sonic*, Tri–Homo Division, Sonic Corp., One Research Drive, Stratford, CT 06497.
"Evolutionary Engineering", *Brochure for Charles Ross & Son Company*, P.O. Box 12308, 710 Old Willets Path, Hauppauge, NY 11788–4193.
"Cavitron Reactor Systems", Brochure for Arde Barinco, Inc., 500 Walnut Street, Norwood, NJ 07648.
"Dicon In–Line Dispersing Grinders", Brochure for Arde Barinco, Inc., 500 Walnut Street, Norwood, NJ 07648.
"Dispersing, Grinding, Shearing, Chopping", *Brochure for Arde Barinco*, 19 Industrial Ave., Mahwah, NJ 07430.
"The Reversible Mixer", *Brochure for Arde Barinco, Inc.*, 500 Walnut Street, Norwood, New Jersey 07648.
"Wet Mixing & Homogenizing Machines", *Brochure for Bematek Systems, Inc.*, 12 Tozer Road, P.O. Box 264, Beverly, MA 01915.
"Brogtec Mischtechnik GMBH", *Brochure for Brogtec*, D–79618 Rheinfelden, Güterstrasse 1, Germany.
"Collovelox", *Brochure for Brogtec*, D–79618 Rheinfelden, Güterstrasse 1, Germany.
"Cavitron—für die Verfahrenstechnik", *Brochure for Cavitron*, v. Hagen & Funke Gmbh—Verfahrenstechnik, Am Leveloh 9, Industriegebiet Bossel, D–45549 Sprockhövel.
"Charlotte Colloid Mill, State–of–the–Art Product Processing", *Brochure for Chemicolloid Laboratories, Inc.*, 55 Herricks Road, Garden City Park, New York 11040.
"Asphalt Emulsion and The Charlotte Colloid Mill", *Brochure for Chemicolloid Laboratories, Inc.*, 55 Herricks Road, Garden City Park, NY 11040.
"The Boston Shearpump", *Brochure by Copek Industrial, Inc.*, 170 Linden Street, Wellesley, MA 01281.
"Supraton Homogenization, Dispersion and Reaction Machines", *Brochure for Dorr–Oliver Incorporated*, 612 Wheeler's Farm Road, Milford, CT 06460–8719.
"The Mighty Gorator", *Brochure for Dorr–Oliver Incorporated*, 612 Wheeler's Farm Road, Milford, CT 06460–8719.
Fryma Processing Technology and Machine/Systems Fabrication, *Brochure for Fryma–Maschinen Ag*, Postfach 164, CH–4310 Rheinfelden, Switzerland.
"Pipeline Mixers", *Brochure for Greerco Corp.*, P.O. Box 187, 2 Wentworth Drive, Hudson, NH 03051.
"Homomixers", *Brochure for Brochure for Greerco Corp.*, P.O. Box 187, 2 Wentworth Drive, Hudson, NH 03051.
"Colloid Mills", *Brochure for Brochure for Greerco Corp.*, P.O. Box 187, 2 Wentworth Drive, Hudson, NH 03051.
"IKA Maschinenbau", *Brochure for IKA Maschinenbau*, Janke & Kunkel GMBH & Co.KG,, Postfach 1165, D–79216, Staufen.
"JayHawk Mills", *Brochure for Jayhawk Manufacturing Company*, 507 N. Whiteside /P.O. Box 313, Hutchinson, KS 67504–0313.
"The Kady Mill", *Brochure for Kady International*, 127 Pleasant Hill Road, P.O. Box 847, Scarborough, ME 04070–0847.
"Polytron Dispersing and Mixing Technology", Brochure by Kinematica, Inc., *Dispersing and Mixing Technology*, 260 Northland Blvd., Suite 335, Cincinnati, OH 45246.
"Polytron Dispersing and Mixing Technology", Brochure by Kinematica, Inc., *Dispersing and Mixing Technology*, 260 Northland Blvd., Suite 335, Cincinnati, OH 45246.
"Megatron Dispersing and Mixing Technology", Brochure by Kinematica, Inc., *Dispersing and Mixing Technology*, 260 Northand Blvd., Suite 335, Cincinnati, OH 45246.

"Megatron Dispersing and Mixing Technology", Brochure by Kinematica, Inc., *Dispersing and Mixing Technology*, 260 Northland Blvd., Suite 335, Cincinnati, OH 45246.

"Machines and Production Systems for the Pharmaceutical Industry", *Brochure by Koruma Maschinenbau GmbH*, P.O. Box 1160, D–79389 Neuenburg, Germany.

"Multi–Purpose Mills", *Brochure by Koruma Maschinenbau GmbH*, P.O. Box 1160, D–79389 Neuenburg, Germany.

"PUC Colloid Technology", *Brochur by GmbH & Co KG*, D–7550 Rastatt/Baden, P.O.B. 2053.

"Ross X–Series Mixer Emulsifiers", *Brochure by Charles Ross & Son Company*, P.O. Box 12308, 710 Old Willets Path, Hauppauge, NY 11788.

"Trigonal—Maschinen", *Brochure by Siefer Maschinen-Fabrik GmbH & Co KG*, Bahnhofstraβe 114, D–42551, Velbert, Germany.

"MultiMill", *Brochure by Sigma Equipment Corp.*, 39 Westmoreland Avenue, White Plains, New York 10606.

"High Shear In–Line Mixers", *Brochure by Silverson Machines, Inc.*, P.O. Box 589, 355 Chestnut Street, East Longmeadow, MA 01028.

"T.K. Products—Chemical Equipment and System Engineering for Process Industries", *Brochure by T.K. Products*, 1565 N. Harmony Circle, Anaheim, CA 92807.

"T.K. Homo Mixer", *Brochure by Tokushu Kika Kogyo Co., Ltd.*, 16–43, Ebie 8–chome, Fukushima–ku, Osaka, 553, Japan.

"T.K. Pipeline Homo Mixer", *Brochure by Brochure by Tokushu Kika Kogyo Co., Ltd.*, 16–43, Ebie 8–chome, Fukushima–ku, Osaka, 553, Japan.

"T.K. Mycolloider", *Brochure by Tokushu Kika Kogyo Co., Ltd.*, 16–43, Ebie 8–chome, Fukushima–ku, Osaka, 553, Japan.

"Waukesha Colloid Mill", *Brochure by Waukesha Fluid Handling*, 611 Sugar Creek Road, Delavan, WI 53115.

"Waukesha Shear Pump", *Brochure by Waukesha Fluid Handling*, 611 Sugar Creek Road, Delavan, WI 53115.

Dispersing Machines, *Brochure by ystral gmbh*, Maschinenbau + processtechnik, Wettelbrunner Strasse 7, D–7801 Ballrechten–Dotttingen, West Germany.

"Review of Our Program", *Brochure by ystral gmbh*, Maschinenbau + processtechnik, Wettelbrunner Strasse 7, D–7801 Ballrechten–Dottingen, West Germany.

"Quadro–Ytron—The Latest Technology for Wet Mixing", *Brochure by Quadro Process, Inc.*, 613 colby Drive, Waterloo, Ont. Canada N2V 1A1.

"Ytron–Z", *Brochure by Ytron Dr. Karg GMBH*, Osternacher Strasse 50, D–83209 Prien am Chiemsee.

* cited by examiner

COLLOID MILL

BACKGROUND OF THE INVENTION

Industrial-grade mixing devices are generally divided into classes based upon their ability to mix fluids. Mixing is the process of reducing the size of particles or inhomogeneous species within the fluid. One metric for the degree or thoroughness of mixing is the energy density per unit volume that the mixing device generates to disrupt the fluid particles. The classes are distinguished based on delivered energy densities. There are three classes of industrial mixers having sufficient energy density to consistently produce mixtures or emulsions with particle sizes in the range of 0 to 50 microns.

Homogenization valve systems are typically classified as high energy devices. Fluid to be processed is pumped under very high pressure through a narrow-gap valve into a lower pressure environment. The pressure gradients across the valve and the resulting turbulence and cavitation act to break-up any particles in the fluid. These valve systems are most commonly used in milk homogenization and can yield average particle sizes in the 0–1 micron range.

At the other end of the spectrum are high shear mixer systems, classified as low energy devices. These systems usually have paddles or fluid rotors that turn at high speed in a reservoir of fluid to be processed, which in many of the more common is a food product. These systems are usually used when average particle sizes of greater than 20 microns are acceptable in the processed fluid.

Between high shear mixer and homogenization valve systems, in terms of the mixing energy density delivered to the fluid, are colloid mills, which are classified as intermediate energy devices. The typical colloid mill configuration includes a conical or disk rotor that is separated from a complementary, liquid-cooled stator by a closely-controlled rotor-stator gap, which is commonly between 0.001–0.40 inches. As the rotor rotates at high rates, it pumps fluid between the outer surface of the rotor and the inner surface of the stator, and shear forces generated in the gap process the fluid. Many colloid mills with proper adjustment achieve average particle sizes of 1–25 microns in the processed fluid. These capabilities render colloid mills appropriate for a variety of applications including colloid and oil/water-based emulsion processing such as that required for cosmetics, mayonnaise, or silicone/silver amalgam formation, to roofing-tar mixing.

SUMMARY OF THE INVENTION

Existing colloid mills have suffered from a number of performance- and ease-of-use-related problems.

One such problem relates mechanical complexity and stability. In the past, colloid mills have had mill housings for the rotor/stator and separate electrical motors with direct drive, reduction gear-, or belt-drive systems connecting the motors to the mill rotors. Elaborate mechanical isolation is required because both the mill rotor and the electric motor have separate bearing systems. Furthermore, the mechanisms used to enable rotor-stator gap adjustment, worm gear arrangement in one commercial device, have been mechanically complex and potentially dynamic during operation primarily due to thermal expansion effects.

In the present invention, these problems are avoided by relying on a motor-driven shaft configuration. That is, the shaft that drives and connects to the rotor of the colloid mill extends to the electric motor stator of the electric motor. In this way, the mill rotor shaft is directly driven.

The benefits resulting from this configuration primarily concern simplicity. Complex gear or belt drive arrangements between a separate electric motor and the fluid processing components of the colloid mill are avoided. Moreover, the gap between the mill rotor and mill stator can be adjusted simply by axially translating the motor-driven shaft. The small movements, of typically less than a 0.1 inches, have no or negligible effect on the electromagnetic field generation in the electric motor. Moreover, in this configuration, only one set of thrust bearings are required, and these are located very close to the rotor, thus minimizing any thermal expansion effects on the mill rotor-stator gap.

In general, according to one aspect, the invention features a colloid mill comprising a mill stator, a mill rotor, an electric motor stator, and a motor-driven shaft. This motor-driven shaft functions as an electric motor rotor that operates in cooperation with the electric motor stator, but also extends from the electric motor stator to the mill rotor, providing a direct drive arrangement.

In specific embodiments, a gap adjustment system is provided that changes a gap between the mill stator and the mill rotor by axially translating the motor-driven shaft relative to the electric motor stator. Further, the electric motor driven shaft is axially supported to counteract forces generated between the mill stator and mill rotor by at least one thrust bearing, preferably an angular contact bearing set, that is located on the side of the electric motor stator proximal to the mill rotor. As a result, mere radial support bearings are needed on the distal side of the electric motor stator relative to the mill rotor.

Another problem that arises in existing colloid mill designs is related to the stability of the mill rotor-stator gap and specifically the system used to adjust the gap. One of the most common configurations utilizes a worm-gear arrangement. This system, however, is hard to calibrate and can jam or freeze in response to the forces generated between the mill rotor and stator.

This problem is solved in the present invention by providing a timing belt-based arrangement for adjusting the gap. Such a timing belt system provides for no backlash. As a result, a simple hand-operated knob or stepper motor arrangement can be used to control the gap.

Specifically, a thrust bearing is supported in a threaded sleeve that mates with the colloidal mill body. The timing belt engages the sleeve to rotate it relative to the body, thus adjusting the thrust bearings axially and thereby controlling the gap between the mill stator and mill rotor.

In general, according to another aspect, the invention features a gap adjustment system for a colloid mill. The system comprises at least one thrust bearing that supports a shaft carrying a mill rotor in proximity to a mill stator. A threaded sleeve in turn carries the thrust bearing, its threads mating with complimentary threads of a body of the colloid mill. A timing belt, which is supported by the colloid mill body, engages the threaded sleeve to enable rotation relative to the body to thereby translate the thrust bearings, yielding axial movement of the shaft. This changes the gap between the mill stator and mill rotor.

In specific embodiments, a knob is used to manually adjust the timing belt.

In other embodiments, an adjustment motor, such as a stepper motor is used to adjust the timing belt under microprocessor control.

Another problem that arises in existing mills concerns what happens when a customer requires a new colloid mill for a given manufacturing process to handle higher fluid processing rates. In the past, manufacturers have offered larger and smaller-sized colloid mills to meet customer demand. The problem, however, has been that typically when moving to colloid mills of a higher throughput the manufactures have simply offered larger versions of a geometrically similar mill rotor-stator configuration. Put another way, a colloid mill with a higher throughput had a rotor and stator that looked like the colloid mill with a lower throughput but were simply larger. This technique for modifying colloid mill rotor/mill stator configurations to handle higher fluid volumes yields different processing effects on those fluids. The larger colloid mills tended to process the fluid at different energy densities, typically higher than the smaller colloid mills. This was a problem to the customer since it required recalibration of the processing parameters of the fluid in order to maintain a consistent product.

The present invention uses the recognition that the energy density delivered to the fluid or the characteristics that provide a uniform particle size at the output is related to the third power of the rotor speed and the second power of the rotor diameter. As a result, when scaling mill rotor/mill stator configurations to higher fluid throughput and consequently larger rotors, it is necessary to decrease the rotor speed. In order that the fluid has a consistent residence time and velocity gradient in the mill rotor-stator gap, the surface angle or rotor pitch, however, is increased with increases in the size of the rotor to counteract the effects of the slower rotor speeds. This provides kinematic similarity, or similar changes in velocity as the product traverses the mill rotor-stator gap of different sizes of the colloid mill.

In general, according to another aspect, the invention features a family of colloid mills in which the rotor surface pitch angles increase with increases in colloid mill throughputs. Said another way, the mill rotor surface angles and rotor surface lengths are controlled between colloid mills having different throughput in order to standardize the energy input into the processed fluids.

An other problem with existing mills has been colloid mill rotor configurations. Some mills have long slots that extend down the entire face of the mill rotor, whereas other configurations utilize relatively smooth conical- or disk-shaped rotor configurations. Each configuration has its relative advantages and disadvantages. The smooth rotor configuration tends to generate high and consistent shear forces in the processed fluid. The configuration with the long axially and radially running slots provides high fluid throughput rates, while establishing good turbulence.

The present invention utilizes a largely smooth rotor configuration in order to generate uniformly high shear forces, and thus consistency with correspondingly low variance in the particle size in the processed fluid. The inventive rotor, however, adds an annular region extending around the circumference of the rotor that provides an increased mill rotor/mill stator gap between upstream and downstream, relatively smooth, processing surfaces. This region of increased gap is designed to establish a cavitation field to compliment the largely shear-based fluid processing performed by the adjacent smooth rotor surfaces.

In general, according to another aspect, the invention features a colloid mill rotor that comprises a primary processing surface extending annularly around the rotor, and a secondary processing surface, also extending annularly around the rotor downstream of the primary processing surface. An intermediate, annular processing surface is located axially between the primary and secondary processing surfaces and is depressed relative to those surfaces. During operation, the relative operation of the primary and secondary processing surfaces establishes a low pressure region in the enlarged gap created by the intermediate processing surface. This establishes in many cases a cavitation field that compliments the shear processing of the fluid.

In specific embodiments, radially and axially extending slots are provided in the primary processing surface to facilitate the movement of the processed fluid through the gap. These slots in the primary processing surface cooperate with slots in the associated mill stator to facilitate premaceration of the fluid.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, like reference characters refer to the same parts throughout the different views. The drawings are not necessarily to scale, emphasis instead being placed upon illustrating the principles of the invention. Of the drawings.

DETAILED DESCRIPTION OF THE INVENTION

Figure 1:
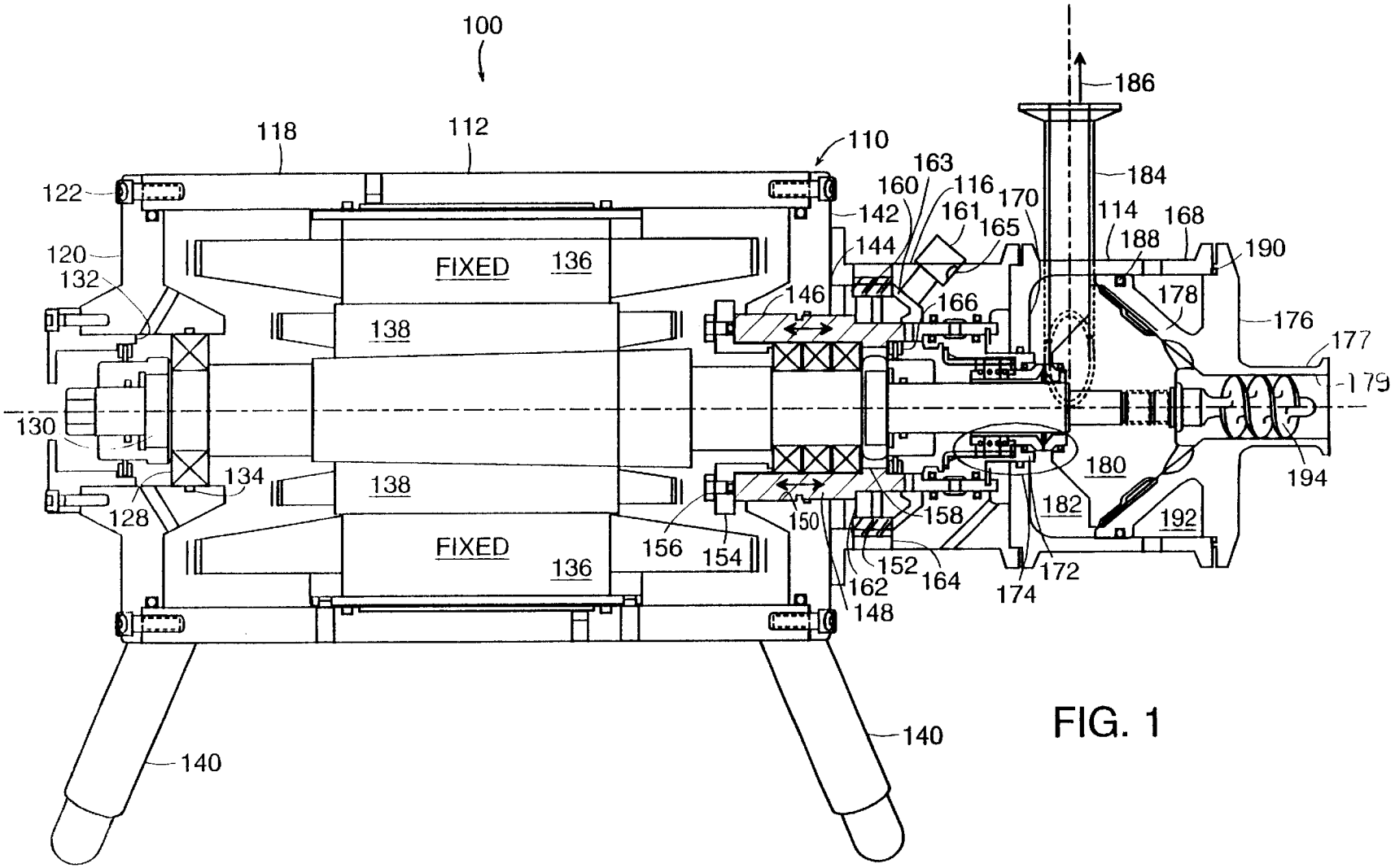
FIG. 1 is a side cross-sectional scale view of a colloid mill of the present invention.

FIG. 1 shows a colloid mill, which has been constructed according to the principles of the present invention. Generally, the colloid mill 100 comprises a body 110 forming the outer casing and structure of the mill 100. The body 110 comprises a motor housing 112 that largely contains the electrical, motor components of the mill 100. The body 110 also comprises a mill housing 114 in which a rotor 180 and stator 178 located, and between which the fluid passes to be processed. Connecting the motor housing 112 with the mill housing 114 is a connecting section housing 116, which contains the mill rotor-stator gap adjustment system and sealing systems to isolate the interior of the electric motor housing 112 from the interior of the mill housing 114.

Turning first to the electric motor housing 112, the motor housing comprises a hollow cylindrical motor jacket 118.

The distal end of the jacket 118 is sealed by a distal motor end-plate 120, which is attached to the jacket 118 via bolts 122. The end plate has a center bore 132 to accommodate the mounting of a motor-driven shaft 130. The distal end of the shaft 130 is supported at the end-plate 120 via radial support bearing 128. The radial support bearing 128 is prohibited from rotating in the inner bore 132 of the end-plate 120 by bearing gasket 134.

Within the electric motor housing, attached around the inter-surface of the jacket 118, are stator coils 136. These cooperate with rotor coils 138 attached to the shaft 130 to generate an electromotive force to drive the shaft 130.

The electric motor housing 112 is supported in this embodiment on a formed baseplate.

The proximal end of the electric motor casing 118 is closed by a proximal end-plate 142. This end-plate has a center bore 144 to accommodate the shaft 130. The center bore 144 has internal threads 146 that cooperate with threads 150 on a thrust bearing sleeve 148.

The thrust bearing sleeve 148 carries, in the illustrated embodiment, three thrust bearings 152, which are preferably angular contact-bearings to provide good rigidity and limit backlash. The thrust bearings are prohibited from axial movement in the distal direction within the bearing sleeve 148 via an annular retaining ring 154 which is bolted to the distal end of the sleeve via bolts 156, and the thrust bearings are retained from moving in the proximal axial direction by lip 158 on sleeve 148.

The shaft 130 is moved axially relative to the body 110 by rotating the bearing sleeve 148 in the proximal end-plate 142. This adjustment allows the control of the mill rotor/stator gap. Bearing sleeve rotation is achieved by a timing belt 160. The timing belt engages a bearing sleeve belt pulley 162 that is rigidly connected to and turns with the thrust bearing sleeve 148. Access is provided to the belt pulley ring 162 via a partially annular slot 164 in the connecting section housing 116. As a result of this configuration, driving the timing belt 160 causes the rotation of the bearing sleeve 148 relative to the mill body 110. This moves the thrust bearing sleeve 148 axially via the interaction between threads 146, 150 to move the thrust bearings 152 and thus the shaft 130 axially. The gap between the processing surfaces of the mill rotor and mill stator is adjustable from approximately 0.001 to 0.050 inches in the preferred embodiment.

Figure 2A:
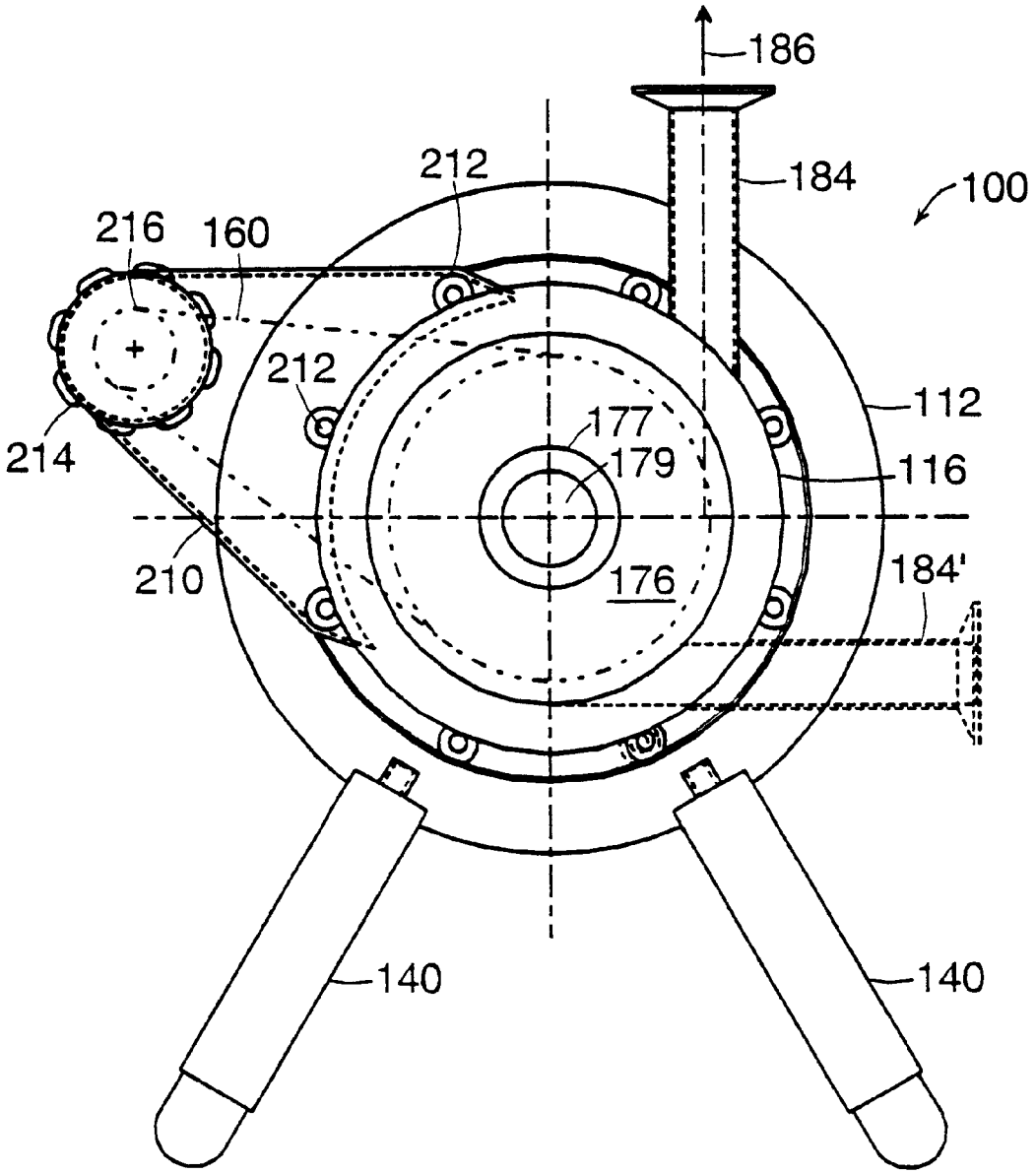
FIG. 2A is a front plan view of the inventive colloid mill.

FIG. 2A is a front view of the colloid mill 100 specifically showing the support system for the timing belt 160. Specifically, a triangular-shaped support bracket 210 extends from the connecting housing 116, being attached by a series of bolts 212. A knob 214 is journaled to the support bracket 210. The path of the timing belt 160 extends from the bearing sleeve belt pulley 162 to an adjustment pulley 216 connected to the knob 214. As a result of this arrangement, manual rotation of the knob 216 rotates the bearing sleeve 148 to move it axially and thus, adjust the gap between the processing surfaces of the mill rotator 180 and mill stator 178.

Figure 2B:
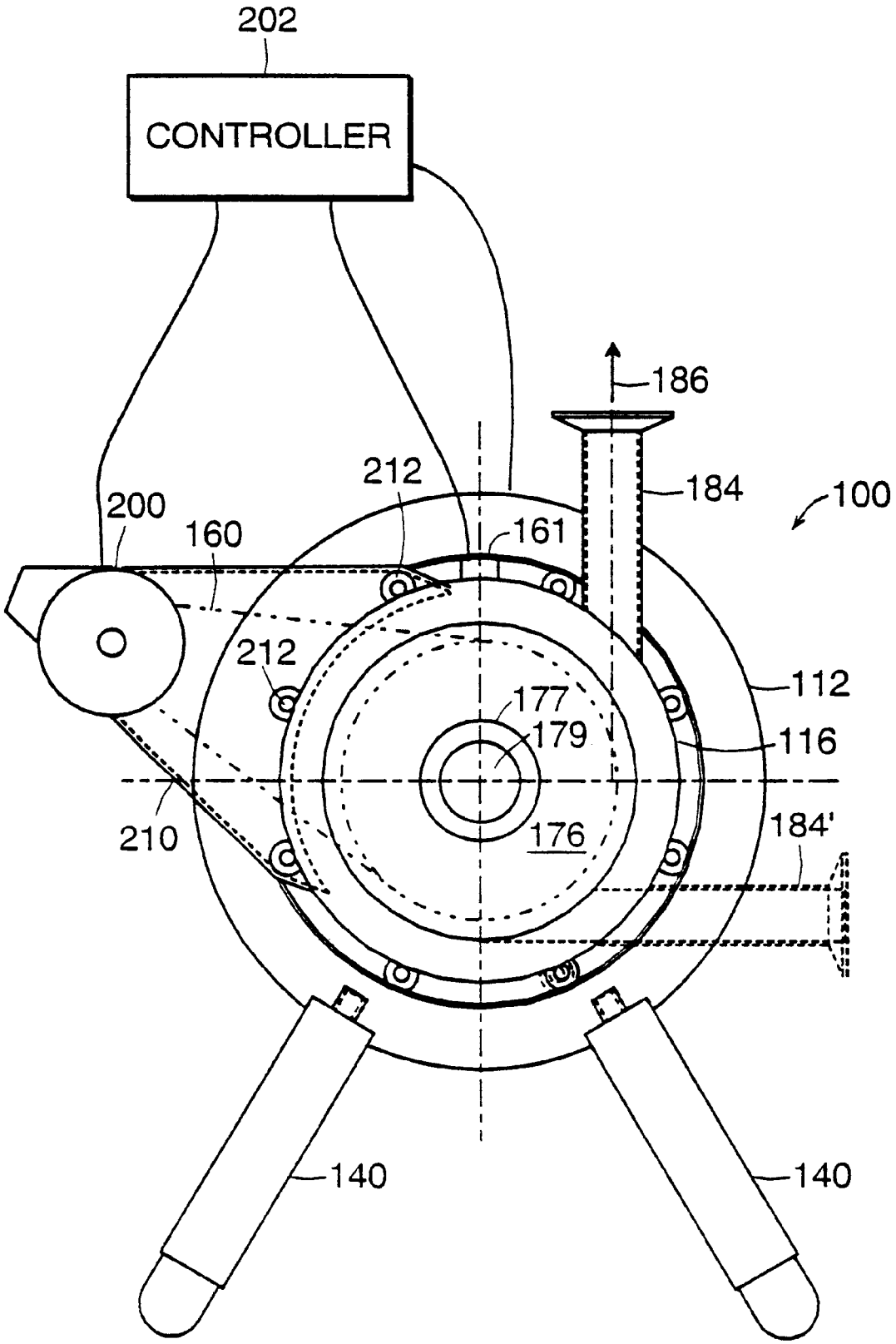
FIG. 2B is a front plan view of the inventive colloid mill according to another embodiment offering automated gap control.

FIG. 2B illustrates an alternative embodiment for effecting mill rotor/stator gap control. Instead of a knob, a stepper motor 200 is used to drive the timing belt 160. The stepper motor 200 is controlled by computer 202 to provide automated control of the rotor-stator gap with feedback from the LVDT 161. This automated system enables better process control since the gap is continuously monitored and adjusted when necessary, and a history of gap size for a processing run is maintained to provide for process validation. Further, it enables clean-in-place operations in which the gap is changed automatically according to a profile while a cleaning solution is passed through the mill, thus requiring limited operator supervision. Preferably, the speed of the shaft 130 is also controlled by modulating the stator and/rotor field current using the computer 202.

In alternative embodiments, the stepper motor is configured to directly turn the bearing sleeve, preferably via a gear train. This configuration is not preferred, however, because of the loss of the beneficial effects of the timing belt, such as backlash control.

Returning to FIG. 1, the belt pulley ring 162 of the bearing sleeve 148 additionally has a system that cooperates with the connecting section housing 116 to indicate or provide a read-out for the mill rotor/stator gap. The pulley ring 162 has an read-out surface 163, the angle of which preferably matches the angle of the rotor. A window 165 is formed in the connecting section housing 116. A linearly variable distance transducer (LVDT) 161 is installed within the window 165 and detects changes in the distance to the read-out surface 163. As a result of this arrangement, by reading-out the distance to the read-out surface 161, the distance between the processing surfaces of the mill rotor 180 and stator 178 is determined electronically by the LVDT 161.

Alternatively, a dial indicator or a digital position indicator can be installed together with or in place of the LVDT so as to permit direct mechanical readout of the mill/rotor/stator gap.

The mill housing 114 is a fluid sealed compartment. It comprises a hollow cylindrical casing 168 with a distal, end-plate 170. The end-plate 170 of the mill housing 114 has a center bore 172 through which the shaft 130 projects into the mill housing 114. A system of seals 174, surrounding the shaft within the center bore 172, prevents contamination from the motor/environment from reaching the fluid to be processed within the housing 114 and prevents processed fluid from escaping into the outside environment from within the mill housing 114. Additionally, a proximal oil seal 166 seals the connecting section housing 116 from the motor housing 112.

The proximal end of the mill housing is sealed via a proximal mill housing end-plate 176, which also functions as the mill stator. Specifically, the proximal mill housing end-plate comprises an axial-extending tubular column 177 providing an input port 179 through which fluid to be processed enters the colloidal mill 100. A corkscrew-shaped fluid pump 194 within the entrance port 179 draws the fluid to be processed into the mill housing 114.

The fluid progresses to the left in the illustration of FIG. 1 to the processing surface of a stator 178, which is an integral part of the mill housing proximal end-plate 176. Rotor 180, which is connected to the shaft 130, pulls the fluid to be processed between the processing surfaces of the rotor 180 and the stator 178 into processed fluid reservoir 182, from which the fluid exits the mill housing 114 via exit tube 184 out through exit port 186.

The proximal mill end-plate 176 is sealed to the mill casing 168 via primary and secondary seals 188, 190. Cooling fluid reservoir 192 in the mill housing proximal end-plate carries a cooling liquid to remove heat generated by the rotor's rotation against the stator 178.

Figure 3:
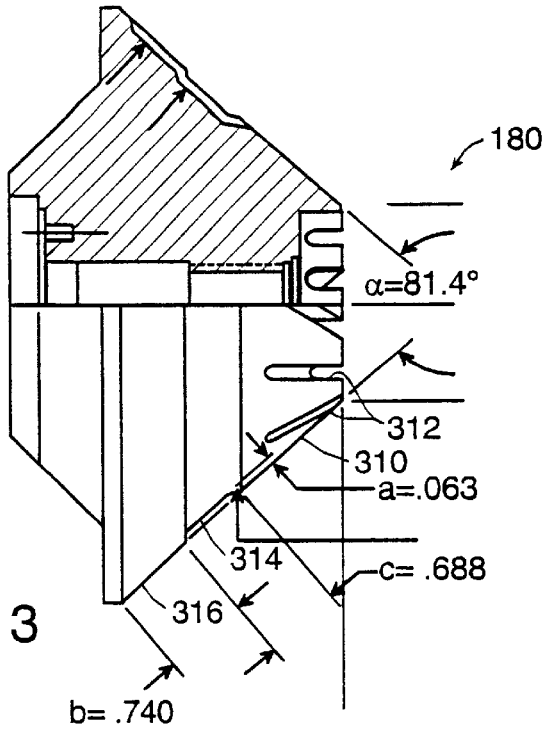
FIG. 3 is a side part plan and part cross-sectional view of the inventive mill rotor.

FIG. 3 is a side, partially cut-away view of a mill rotor constructed according to the principles of the present invention. In the preferred embodiment, the pitch angle of rotor 180 is approximately $\alpha$=81.4 degrees.

Specifically, the mill rotor 180 has an annular primary processing surface 310. A series of radially and axially extending slots 312 are formed in the primary processing surface. The slots facilitate pre-maceration of the incoming fluid.

Downstream of the primary processing surface is an intermediate processing surface 314. This intermediate processing surface is depressed relative to the primary processing surface 310. In the preferred embodiment, it is depressed by approximately a=0.063 inches. This depression, creates a reservoir of fluid in the gap between the intermediate processing surface 314 and the processing surface of stator 178. In this reservoir, a low pressure field is generated which facilitates cavitation. This effect contributes to the mixing of the fluid to be processed and complements the largely shear effects created in the fluid between the primary processing surface 310 and the stator 178. The intermediate processing surface length is c=0.688 inches in the preferred embodiment.

Downstream of the intermediate processing surface 314 is a secondary processing surface 316 also extending annularly around the rotor 180. The secondary processing surface 316 is raised above the intermediate processing surface 314 by essentially the same distance as the primary processing surface is above the intermediate processing surface. Both the intermediate and secondary processing surfaces are continuous in contrast to the primary processing surface 310 that has the slots 312. In the preferred embodiment, the surface length of the secondary processing surface 310 is b=0.74 inches.

Figure 4:
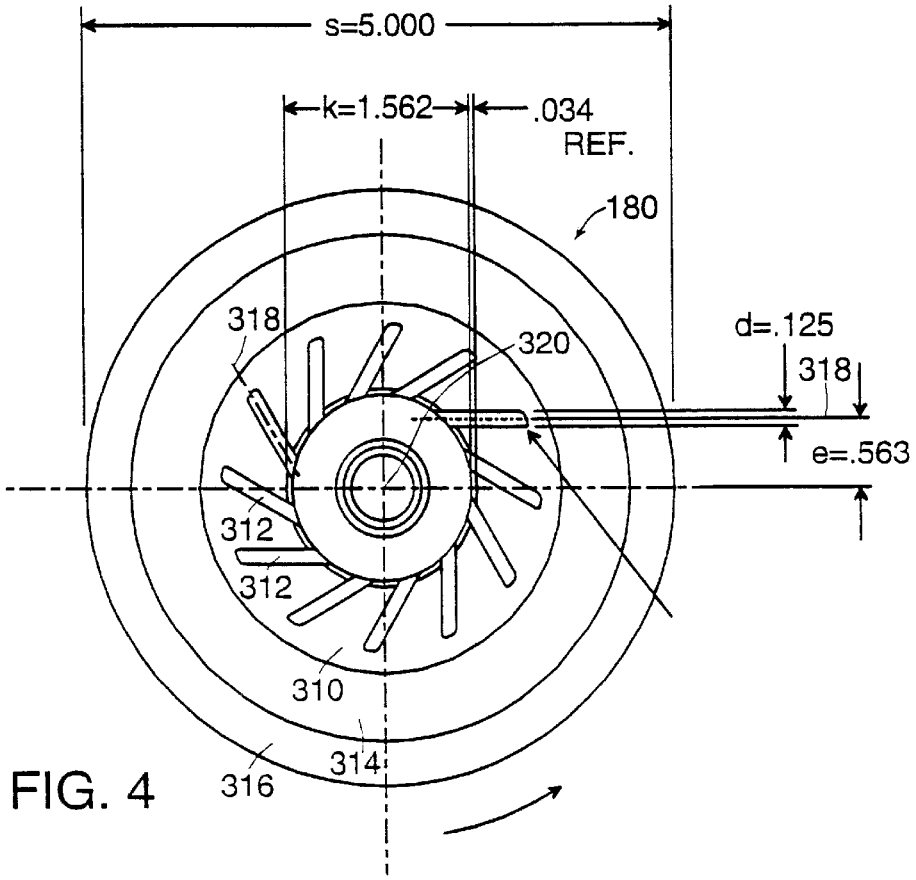
FIG. 4 is a top plan view of the inventive rotor.

FIG. 4 is a top plan view of the rotor 180, showing the primary processing surface 310, the intermediate processing surface 314 and the secondary processing surface 316. Also shown are the array of slots 312 in the primary processing surface 310. In the preferred embodiment, 12 slots are provided evenly spaced around the circumference of the rotor. Also as shown, the central line 318 of the slots 312 does not pass through the axis of rotation 320 of the rotor 180. There is a distance of e=0.563 inches between the center line of slot 312 and a line extending parallel to the slot centerline 318 through the axis of rotation 320 of the rotor 180. In the preferred embodiment, the slots are approximately d=0.125 inches wide. Additionally, the total diameter of the rotor 180 is j=5.0 inches and the center diameter is k=1.562 inches.

Figure 5:
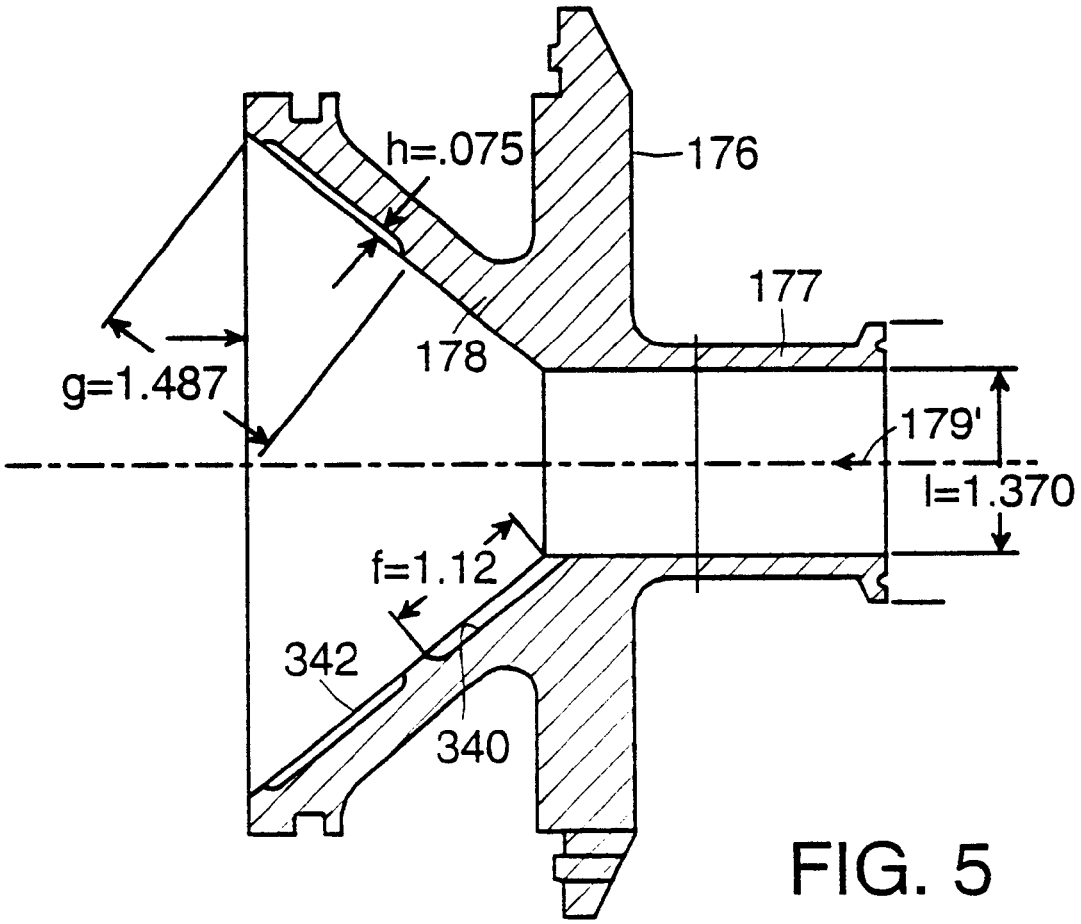
FIG. 5 is a side cross-sectional view of the mill stator and housing proximal end-plate.

FIG. 5 is a cross sectional view of the proximal mill housing end-plate 176. A series of stator slots 340 are formed on the inner surface of the stator 178. These slots are f=1.2 inches long. Downstream of the slots' termini is a hardened annular section 342 of the stator 178. Specifically, this hardened section is approximately g=1.487 inches long and is filled with STELLITE to a depth of h=0.075 inches in order to provide a long-wearing processing surface.

Figure 6:
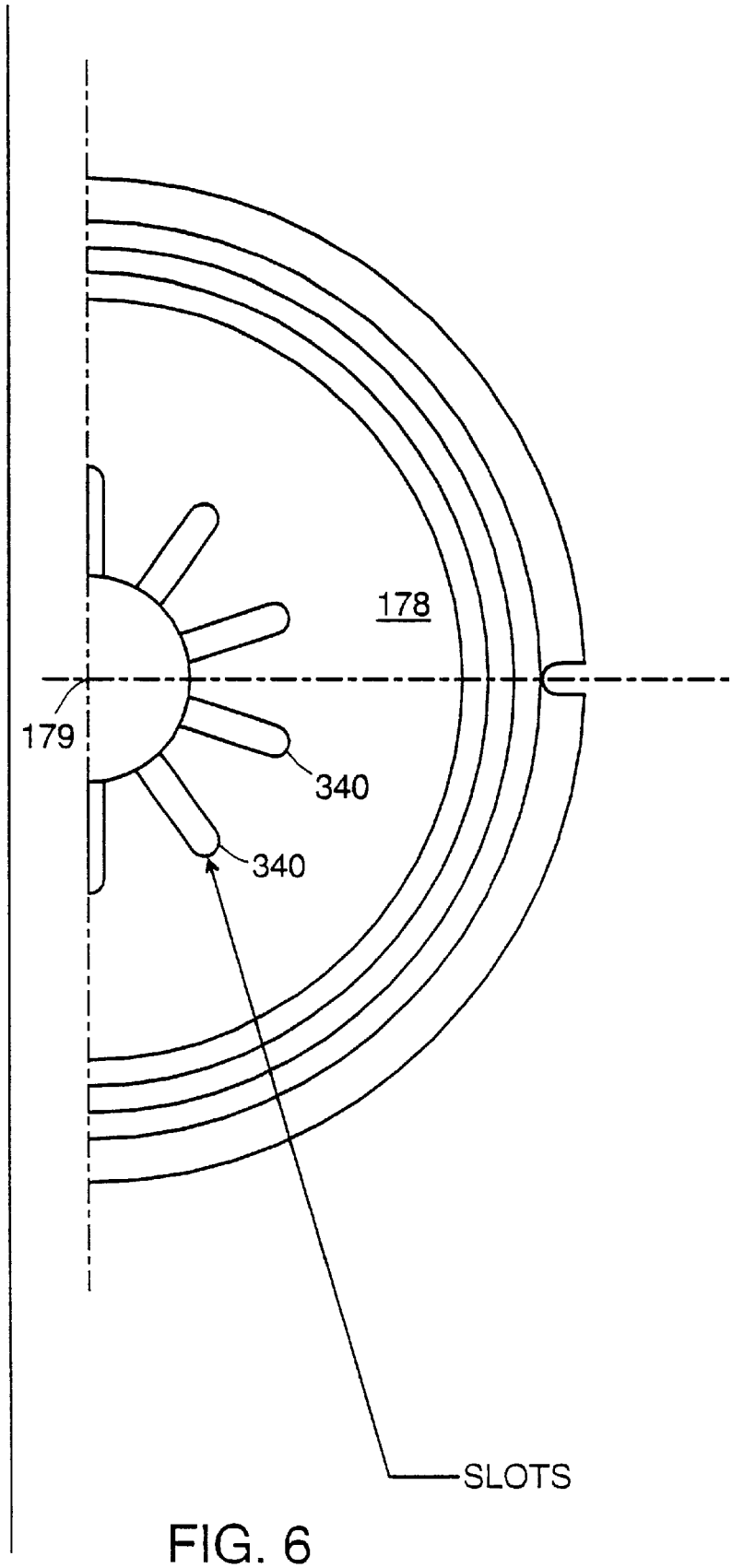
FIG. 6 is a partial plan view of the mill stator according to the present invention.

FIG. 6 is a plan view of the stator 178 looking out through the input port 179. This view shows that in the preferred embodiment, ten of the slots 340 are provided in the inner surface of the stator evenly spaced and extending in a radial direction.

A different number of rotor slots than stator slots is used so to remove any beating and thereby minimize vibration. As a result, the slots in the rotor do not all confront a slot in the stator at the same time during rotation. Further, the rotor slots 312 are angled with respect to the stator slots 340. This feature creates the effect of the stator slots 340 moving radially outward and downward over the rotor slots 312 as the rotor 180 turns. This generates a pressure-popping effect that facilitates mixing.

Figure 7:
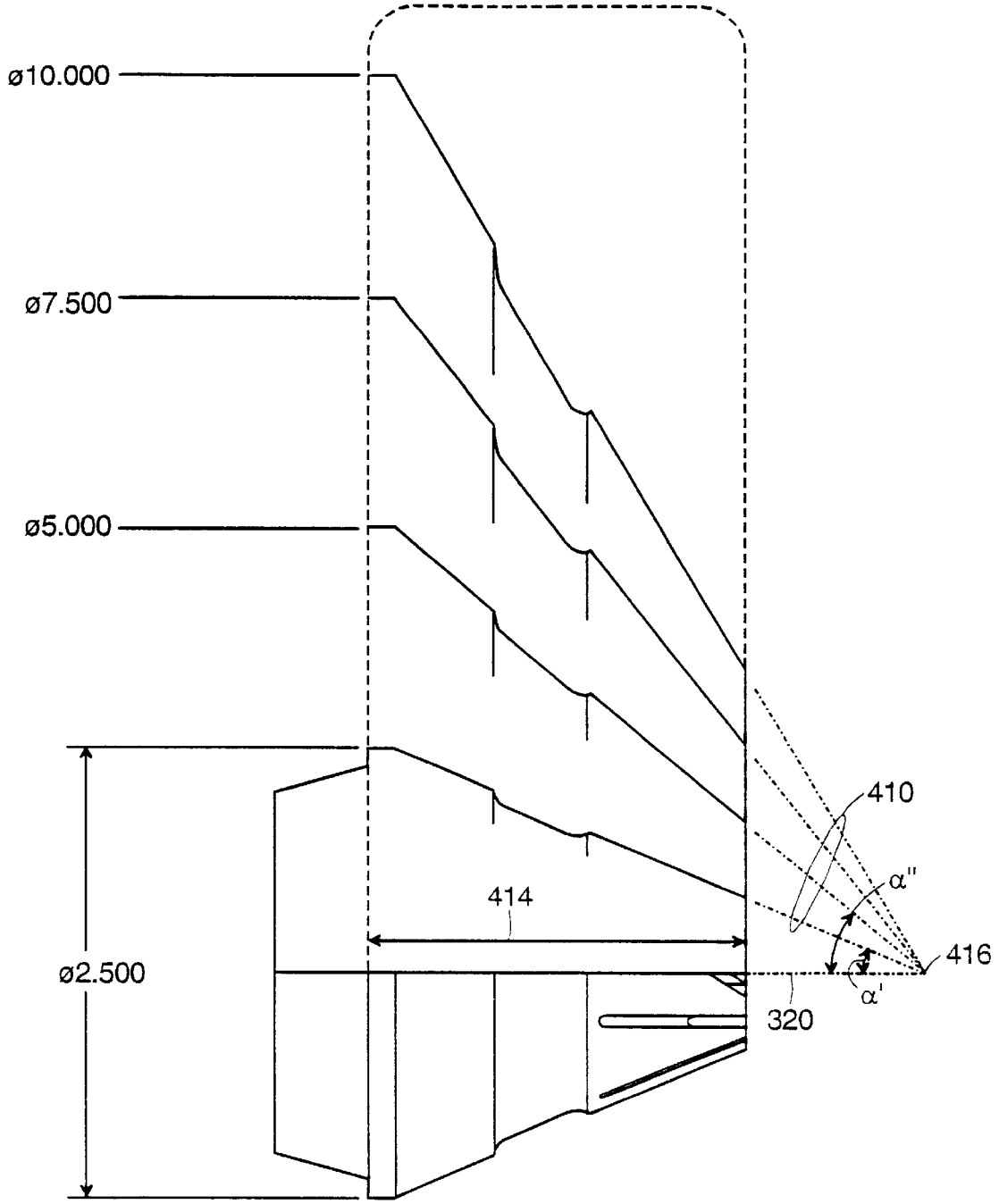
FIG. 7 is a schematic diagram illustrating the difference in rotor surface angles with increases in rotor size to accommodate larger fluid throughput according to the present invention.

FIG. 7 illustrates the relationship between colloid mill rotors for colloid mills of different throughputs, when the rotors are constructed according to the principles of the present invention.

According to the present invention, the intent is to match the energy input per unit volume into the fluid across the range of colloid mills with different fluid throughput. This is achieved by maintaining the same value of the rotor speed, in revolutions per minute, to the third power, times rotor diameter to the second power ($N^3D^2$) at the exit of the milling gap. The time over which a given volume of fluid is processed in the mills' rotor/stator gaps and the change in milling intensity is standardized between different throughput mills by maintaining the same percent change in velocity of the processed fluid as it moves down the processing surface of the rotor.

If bar 414 is defined as an arbitrary axial length of a potential rotor for a colloid mill of the present invention, and 416 is a point selected along the rotor's axis of rotation 320, then where rays 410, evenly spaced about the axis of rotation, cut through the bar defines the rotor's processing surfacing length and rotor diameter. The angle $\alpha'$ between the rays defines the rotor's pitch angle. To design a rotor for a higher throughput colloid mill, rays 412 from point 416 are defined at an increased rotor pitch angle $\alpha'$. Where these new rays cross bar 414, they define the rotor processing surface length and rotor diameter. As a result, the rotor pitch angle increases with increases in the rotor diameter and thus colloid mill throughput according to the present invention. Processed fluid moves at the same velocity through the gap regardless of rotor size. The increases in pitch has the effect of exposing the fluid to increases in the centripetal force even though the net force remains the same due to the decreased speed at which the larger rotors are run.

While this invention has been particularly shown and described with references to preferred embodiments thereof, it will be understood by those skilled in the art that various changes in form and details may be made therein without departing from the spirit and scope of the invention as defined by the appended claims. Those skilled in the art will recognize or be able to ascertain using no more than routine experimentation, many equivalents to the specific embodiments of the invention described specifically herein. Such equivalents are intended to be encompassed in the scope of the claims.

What is claimed is:

1. A colloid mill comprising:

a mill stator;

a mill rotor;

an electric motor stator;

an electric motor rotor;

a common motor shaft that extends from the mill rotor to the electric motor rotor such that the mill rotor is directly driven by the motor rotor; and a gap adjustment system that changes a gap between the mill stator and the mill rotor, the gap adjustment system including at least one thrust bearing that supports the motor shaft, a threaded sleeve that carries the thrust bearing, and a colloid mill body having complementary threads engaging the threaded sleeve to enable rotation of the threaded sleeve relative to the colloid mill body to translate the thrust bearing for changing the gap between the mill stator and the mill rotor.

2. A colloid mill as described in claim 1, further comprising:

a colloid mill body containing the electric motor stator, electric motor rotor, mill stator, and mill rotor; and a thrust bearing that supports the motor-driven shaft against axial forces generated between mill stator and mill rotor.

3. A colloid mill as described in claim 2, wherein the at least one thrust bearing comprises angular contact bearings.

4. A colloid mill as described in claim 2, wherein the thrust bearing is located on a side of the electric motor rotor proximal to the mill rotor.

5. A colloid mill as described in claim 4, further comprising radial support bearings that support the motor-driven shaft on a distal side of the electric motor stator relative to the mill rotor.

6. A colloid mill as described in claim 1, further comprising a timing belt supported by the colloid mill body and engaging the threaded sleeve.

7. A colloid mill as described in claim 6, further comprising means for manually adjusting the timing belt.

8. A colloid mill as described in claim 6, further comprising an adjustment motor that adjusts the timing belt under computer control.

9. A colloid mill as described in claim 1, further comprising a gap detection system that determines a size of the gap between the mill stator and the mill rotor.

10. A colloid mill comprising:

a mill stator;

a mill rotor;

an electric motor stator;

common motor shaft means for driving the mill rotor extending from the mill rotor to the electric motor rotor such that the mill rotor is directly driven by the motor rotor; and gap adjustment means for changing a gap between the mill stator and the mill rotor, the gap adjustment means including at least one thrust bearing that supports the motor shaft, a threaded sleeve that carries the thrust bearing, and a colloid mill body having complementary threads engaging the threaded sleeve to enable rotation of the threaded sleeve relative to the colloid mill body to translate the thrust bearing for changing the gap between the mill stator and the mill rotor.

* * * * *